US006145732A

United States Patent [19]

Akins et al.

[11] Patent Number: 6,145,732

[45] Date of Patent: Nov. 14, 2000

[54] CYLINDRICAL HELICAL SEAMED TUBE AND METHOD AND APPARATUS THEREFORE

[75] Inventors: Edward A. Akins, P.O. Box 158, St. Boniface, Manitoba, Canada, R2H 3B4; George Harms, St. Boniface, Canada

[73] Assignee: Edward A. Akins, Manitoba, Canada

[21] Appl. No.: 09/421,684

[22] Filed: Oct. 20, 1999

[51] Int. Cl.[7] ..... B21C 37/12; B21C 37/08; B21D 39/02; B21D 39/06

[52] U.S. Cl. ..... 228/145; 72/49; 72/50

[58] Field of Search ..... 228/145, 17.7, 228/144; 72/49, 50; 140/76; 493/303, 304, 305, 306, 307; 219/155

[56] References Cited

U.S. PATENT DOCUMENTS

| | | |
|---|---|---|
| 3,604,464 | 9/1971 | Pelley . |
| 3,726,463 | 4/1973 | Haffmann et al. . |
| 4,061,264 | 12/1977 | Bartels et al. . |
| 4,141,481 | 2/1979 | Van Petten . |
| 4,305,460 | 12/1981 | Yampolsky . |
| 4,438,643 | 3/1984 | Menzel et al. . |
| 4,501,948 | 2/1985 | Yampolsky et al. . |
| 4,763,830 | 8/1988 | Davis . |
| 5,001,819 | 3/1991 | Harrop . |

*Primary Examiner*—Patrick Ryan
*Assistant Examiner*—Colleen Cooke
*Attorney, Agent, or Firm*—Charles G. Lamb; Middleton & Reutlinger

[57] ABSTRACT

A cylindrical helical seamed metal tube wherein the seam thereof is at an angle of between 1 and 25 degrees with respect to the axis of the tube. A method of making the tube comprises the steps of continuously feeding the metal strip into a tubing former to form the metal strip into a helical tube with the leading and trailing edges juxtaposed, the feeding such that the strip longitudinal axis is at a substantially constant acute angle with respect to the tube longitudinal axis of between 1 and 25 degrees. After the tube is substantially formed, applying pressure on at least the leading edge, leading portion, trailing edge and trailing portion in the direction of the cylindrical wall such that same substantially conform to the cylindrical wall. The juxtaposed leading and trailing edges are fused together to form a fused seam, and maintained in a juxtaposed position until the seam cools sufficiently to maintain the juxtaposed position. An apparatus for making the tube is also provided.

11 Claims, 7 Drawing Sheets

CYLINDRICAL HELICAL SEAMED TUBE AND METHOD AND APPARATUS THEREFORE

This invention is in the field of formed metal products and in particular provides a cylindrical helical seamed tube wherein the seam thereof is at an angle of less than 25 degrees, and an apparatus and method for forming same.

BACKGROUND OF THE INVENTION

Metal tubing is commonly made in a conventional tubing mill by feeding a strip of metal into a hollow cylindrical shoe with the longitudinal axis of the metal strip aligned with the axis of the shoe and the finished tubing. The welded seam is straight down the side of the tubing, aligned with the axis of the tubing as well. This requires that the width of the metal strip being formed is substantially equal to Π times the diameter of the tubing being made (ΠD). For example, for 2 inch tubing these conventional tubing mills require a strip of metal 3.14×2 inches=6.28 inches in width. Tubing mills for manufacturing such tubing are complex and costly.

It is also known to manufacture helical seamed tubing wherein a narrow metal strip is fed at an angle into a cylindrical shoe to form a hollow tube with a helical seam which is then welded. An apparatus and method for forming helical seamed tubing with a diameter of 0.5 to 2 inches is disclosed in U.S. Pat. No. 4,501,948 to Yampolsky et al. The Yampolsky patent is directed to controlling the tendency of the seam to separate once it leaves the cylindrical shoe, the control being necessary in order to maintain the seam closed in such a manner that it can be effectively welded.

Cylindrical helical seamed tube wherein the seam thereof is at an angle of less than 25 degrees with respect to the axis of said tube is not known in the prior art.

In prior art helical seamed tubing, the strip of metal used to form the tubing is substantially narrower than that needed to form straight seam tubing and the angle between the longitudinal axis of the tubing being formed and the longitudinal axis of the metal strip being fed into the cylindrical dye is relatively large. In the Yampolsky device this angle is 33 degrees. This angle corresponds to the angle between the welded seam of the tubing and the axis of the tubing. At angles less than this, the edges of the metal strip are not effectively formed and result in flat spots and bulges along the edge which cannot be effectively welded.

Helical seamed tubing with this large angle of 33 degrees between the respective axes requires a much longer seam and therefore substantial welding. For a 10 foot length of tubing, the Yampolsky device requires a weld that is approximately 11.923 feet long, an increase of 19.23% in weld length compared to a straight seam tubing. This increased length of welding is costly and causes high temperatures in the tubing and distortion.

As the seam angle increases the tube has reduced strength as well which is undesirable in most applications. A tube with a seam angle that was less than 25 degrees would be stronger, and a tube with a seam angle approaching one degree would have very similar strength to a conventional straight seam tube.

Metal coil is conventionally manufactured in standard widths and when customers order a particular width there is a left over strip which is available at a much reduced price, since its uses are very limited. In a conventional straight seam 2 inch tubing mill, any strips of material that are less than approximately 6.28 inches in width are not suitable to form the material. These narrower strips can be purchased very cheaply, since there are few uses and therefore little demand for them.

A cylindrical helical seamed tube with a low helix angle and strength approaching that of a conventional straight seam tube would be desirable, as the cost of metal to make same would be reduced.

Such a tube, and a method and apparatus of making same from a strip of metal that is only slightly narrower than ΠD would be advantageous, as the helical seam would be relatively long as opposed to conventional helical seamed tubing, thereby requiring only slightly more welding than the conventional straight seam tube. For example with an angle between the longitudinal axis of the tubing being formed and the longitudinal axis of the metal strip being fed into the cylindrical dye of only 10 degrees, a 10 foot length of tubing requires a weld that is only approximately 10.15 feet long, an increase of only 1.5% in weld length compared to a straight seam tubing.

Such a method an apparatus that allowed for forming a tube of a particular diameter from various widths of material would be particularly advantageous, as it would increase the sources of suitable material, and decrease the cost of the metal strip.

SUMMARY OF THE INVENTION

It is the object of the present invention to provide substantially cylindrical helical seamed tubing wherein the angle between the helical seam and the axis of the tubing made is between 1 and 25 degrees as well as a method of, and apparatus for, making same from a metal strip that is somewhat less than Π times the outside diameter of the tubing made.

It is a further object of the present invention to provide such a method and apparatus wherein tubing with a given outside diameter may, with some adjustment, be made from metal strip of different widths.

The invention accomplishes its objects providing in one aspect a cylindrical helical seamed metal tube wherein the seam thereof is at an angle of between 1 and 25 degrees with respect to the axis of said tube.

In a second aspect the invention provides a method of making cylindrical helical seamed tube, having a tube longitudinal axis, from a metal strip having a strip longitudinal axis and parallel longitudinal edges being a leading edge, adjacent a leading portion of said metal strip, and a trailing edge, adjacent a trailing portion of said metal strip, comprising the following steps: continuously feeding said metal strip into a tubing former to form said metal strip into a helical tube with said leading and trailing edges juxtaposed, said tubing former defining an aperture with a cylindrical wall, said feeding such that said strip longitudinal axis is at a substantially constant acute angle with respect to said tube longitudinal axis, said acute angle being between 1 and 25 degrees; after said tube is substantially formed within said tubing former with said leading and trailing edges juxtaposed, applying pressure on at least said leading edge, leading portion, trailing edge and trailing portion in the direction of said cylindrical wall such that said leading edge, trailing edge and trailing portion substantially conform to said cylindrical wall; fusing said juxtaposed leading and trailing edges together to form a fused seam; and maintaining said leading and trailing edges in a juxtaposed position until said seam cools sufficiently to maintain said juxtaposed position.

The disclosed method allows for making metal tubing from metal strip that is slightly narrower than ΠD. Prior art helical seamed tubing is not available with these small angles between the seam and tubing axis.

In a third aspect the invention provides an apparatus for making cylindrical helical seamed tube, having a tube longitudinal axis, from a metal strip having a strip longitudinal axis and parallel longitudinal edges being a leading edge, adjacent a leading portion of said metal strip, and a trailing edge, adjacent a trailing portion of said metal strip, said apparatus comprising: a tubing former operable to form said metal strip into a helical tube with said leading and trailing edges juxtaposed, said tubing former defining an aperture with a cylindrical wall; means for continuously feeding said metal strip into said tubing former, said means for continuously feeding operative to maintain said strip longitudinal axis at a substantially constant acute angle with respect to said tube longitudinal axis, said acute angle between 1 and 25 degrees; first means to apply pressure, after said tube is substantially formed within said tubing former with said leading and trailing edges juxtaposed, on at least said leading edge, leading portion, trailing edge and trailing portion in the direction of said cylindrical wall such that said leading edge, leading portion, trailing edge and trailing portion substantially conform to said cylindrical wall; means for welding said juxtaposed leading and trailing edges together to form a seam; and means for maintaining said leading and trailing edges in a juxtaposed position until the weld cools sufficiently to maintain said juxtaposed position.

In a fourth aspect the invention provides an apparatus for making cylindrical helical seamed tube, having a tube longitudinal axis, from a metal strip having a strip longitudinal axis and parallel longitudinal edges being a leading edge, adjacent a leading portion of said metal strip, and a trailing edge, adjacent a trailing portion of said metal strip, said apparatus comprising: a bottom feed plate; a metal strip drive for advancing said metal strip along said bottom feed plate and through said apparatus; a tube former for forming said metal strip into a tube, said tube former defining at least a portion of a cylindrical wall at an entrance end thereof and defining a cylindrical aperture at an exit end thereof, the diameter of said cylindrical wall and said cylindrical aperture being substantially equal to the outside diameter of the tube being formed, said tube former arranged such that the arc of said cylindrical wall is tangentially coincidental with the top of said bottom feed plate such that metal strip advancing along said bottom feed plate will follow said portion of a cylindrical wall; said bottom feed plate arranged to feed said metal strip into said tube former such that the angle between said strip longitudinal axis and said tube longitudinal axis is substantially constant and between 1 and 25 degrees, and such that said leading and trailing edges are juxtaposed at said exit end of the tube former; a first roller arranged such that said leading edge and leading portion pass between said first roller and said cylindrical wall and are forced into substantial conformity with said cylindrical wall; second, third and forth rollers arranged inside said cylindrical aperture such that said metal strip passes between said second, third and fourth rollers, and said cylindrical aperture such that at least said leading edge, leading portion, trailing edge and trailing portion of the metal strip are forced into substantial conformity with said cylindrical aperture; a welding head positioned adjacent to the exit end of said tube former and operable to weld said juxtaposed leading and trailing edges together to form a welded seam; and a cooling die defining a cooling aperture sized to accommodate said welded tube and positioned such that said welded tube passes through said cooling aperture and is maintained in its desired tubular form until said welded seam cools sufficiently to maintain said desired tubular form.

The apparatus could further comprises a top feed plate arranged above the bottom feed plate such that the metal strip advances between the top and bottom feed plates. The metal strip is thereby confined between the top and bottom feed plate, which prevent buckling of the metal strip under the forces of the drive means.

The metal strip drive could comprise at least one pair of upper and lower drive rollers each bearing against the metal strip as it passes therebetween. These upper and lower drive rollers could bear against the metal strip through apertures in the top and bottom feed plates, thereby maintaining the constricted position of the metal strip between the top and bottom feed plates during driving. The apertures need only be long enough so that the rollers bear on the metal strip. For positive driving, at least one pair of upper and lower drive rollers could act on the metal strip after the leading edge thereof has already entered the tube former and has been partially formed thereby. This puts a driving force at the closest position to the tube former, and where the partially formed tube has some structural rigidity, reducing the tendency of the metal strip to buckle.

The apparatus could be adjustable to make cylindrical tubing of the same outside diameter from metal strip of different widths. The angle of the feed plate could be adjustable so as to allow the angle between the axis of the metal strip and the axis of the formed tubing to be changed, and thereby accommodate metal strip of different widths.

BRIEF DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE PREFERRED EMBODIMENTS

Figure 1:
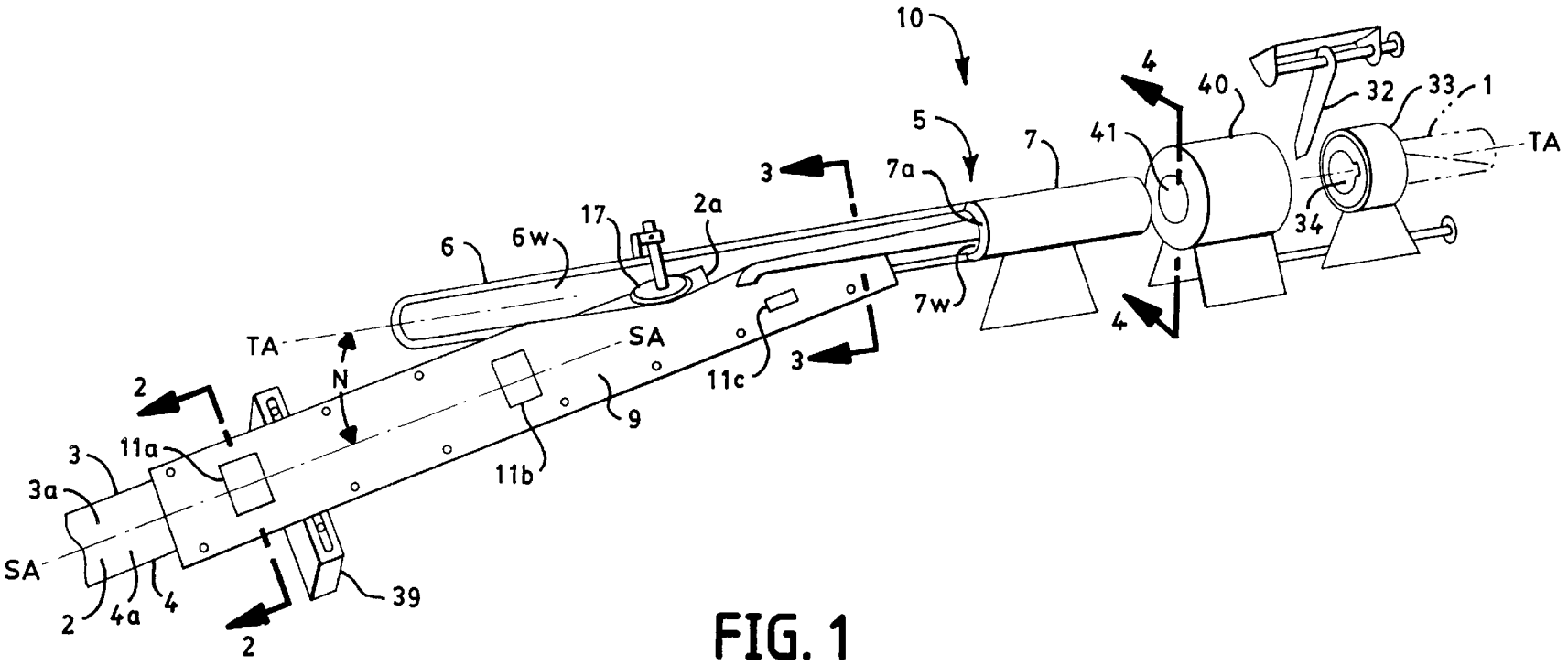
FIG. 1 is a perspective schematic view of an apparatus for making the tube of the invention.

The invention provides an apparatus 10 illustrated in FIG. 1, for making cylindrical helical seamed tube 1 having a tube longitudinal axis TA, from a metal strip 2 having a strip longitudinal axis SA and parallel longitudinal edges being a leading edge 3, adjacent a leading portion 3*a* of the metal strip 2, and a trailing edge 4, adjacent a trailing portion 4*a* of the metal strip 2. FIG. 1 shows the end 2*a* of the metal strip 2 just entering the apparatus 10. The tube 1 is illustrated in phantom only at the exit end of the apparatus 10, and drive and frame components have been omitted so that the working components of the apparatus 10 may be more clearly seen.

Figure 15:
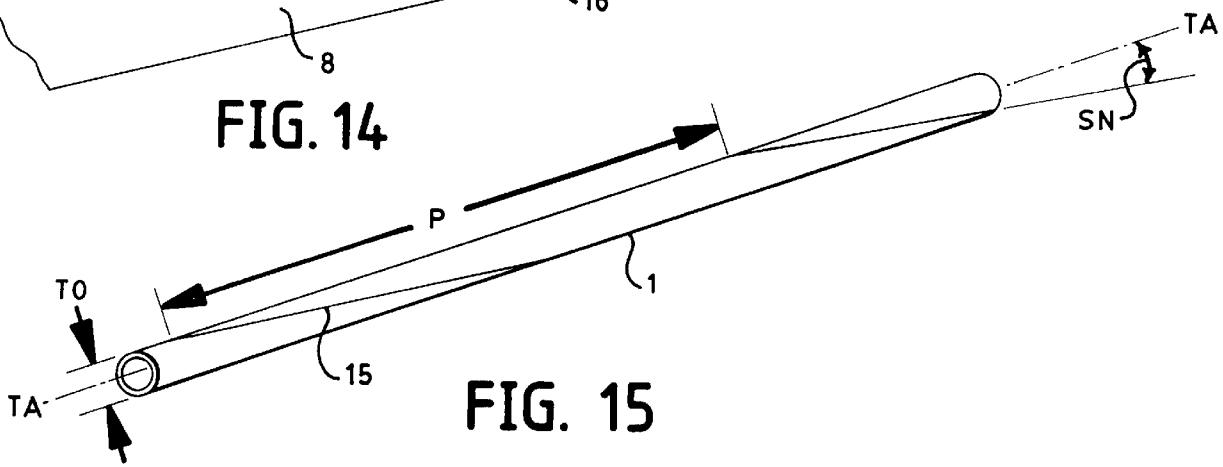
FIG. 15 shows a finished tube.

FIG. 15 illustrates an example of the cylindrical helical seamed metal tube made by the apparatus 10. Seam 15 is at angle SN of approximately three degrees with respect to the tube axis TA, and the pitch P is approximately 20 times the tube diameter TD. The angle SN, and thus the pitch P may be varied to accommodate making tube 1 of the same diameter from metal strip 2 of different widths. For example to make 2 inch tube from a 6 inch wide strip, the pitch P is approximately 38.25 inches, while with 2 inch tube from a 5.93 inch wide strip, the pitch P is approximately 32 inches.

Figure 2:
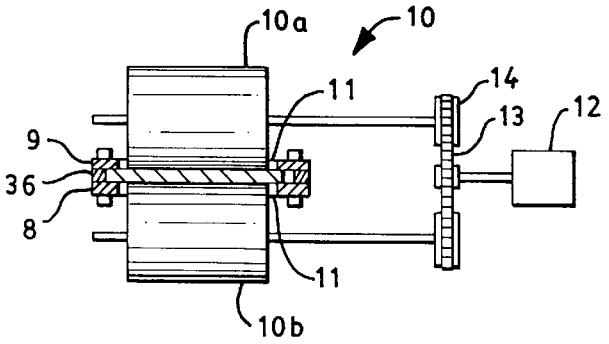
FIG. 2 is a sectional view along 2—2 of FIG. 1, with drive rollers and drive motor added.
Figure 3:
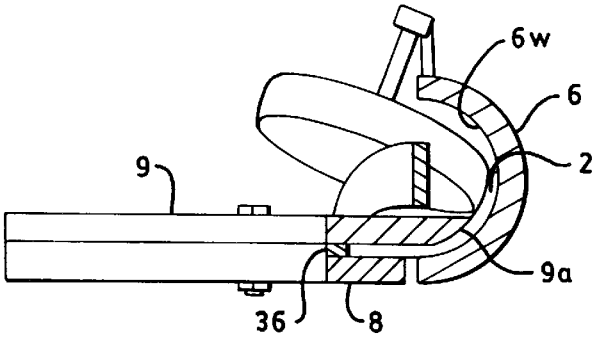
FIG. 3 is a sectional view along 3—3 of FIG. 1.

The apparatus 10 includes means for continuously feeding the metal strip 2 into a tube former 5. In the illustrated embodiment, and as best seen in FIGS. 2 and 3, the feeding means comprises a bottom feed plate 8 and a top feed plate 9, and three pairs 10 of upper and lower drive rollers 10*a*, 10*b*. The upper and lower drive rollers 10*a*, 10*b* bear against the top and bottom of the metal strip 2 through holes 11 in the top and bottom feed plates 9, 8 and drive the metal strip 2 between the top and bottom feed plates 9,8 and through the apparatus 10. A guide 36 is provided which bears against the trailing edge 4 of the metal strip 2 as it is fed into the tube former 5. Once the metal strip 2 is in the tube former 5, the trailing edge 4 does not bear against the guide 36. It is contemplated that a temporary guide for starting the metal strip 2 into the tube former 5 would be effective.

The drive roller pairs 10 are located at 11*a*, 11*b* and 11*c* in FIG. 1. The drive roller pair 10 at 11*c* is narrower than the others, since at this location the leading portion 3*a* of the metal strip 2 is already partially formed. Driving the metal strip 2 at this location is desirable as the metal strip 2 is partially formed and therefore has some structural rigidity that the flat metal strip 2 does not, allowing more force to be applied in the direction of the strip longitudinal axis SA and into the tubing former 5. The upper and lower drive rollers 10*a*, 10*b* are rotated by motor 12 driving chain 13 and sprockets 14.

The tube former 5 forms the metal strip 2 into a tube 1. The tube former 5 comprises a forming shoe 6 and a sizing shoe 7. The forming shoe 6 is located at the entrance end of the tube former 5 and defines one half of a cylindrical wall 6*w*. This half cylindrical wall 6*w* is mounted to coincide with the full cylindrical wall 7*w* of the cylindrical aperture 7*a* in the sizing shoe 7 which is located at the exit end of the tube former 5. The diameter of the cylindrical wall 6*w* and the cylindrical aperture 7*a* are substantially equal to the outside diameter of the tube 1 being formed.

The tube former 5 is arranged such that the arc of the cylindrical wall 6*w* is tangentially coincidental with the top of the bottom feed plate 8 such that the metal strip 2 advancing along the bottom feed plate 8 will follow the cylindrical wall 6*w* and be formed thereby.

The drive roller pairs 10 and top and bottom feed plates 9, 8 are arranged to feed the metal strip 2 into the tube former 5 such that the angle N between the strip longitudinal axis SA and the tube longitudinal axis TA is substantially constant and between 1 and 25 degrees. For different widths of metal strip 2, the angle N must be adjusted so that the leading and trailing edges 3, 4 of the metal strip 2 are juxtaposed when the tube 1 exits the sizing shoe 7.

Figure 12:
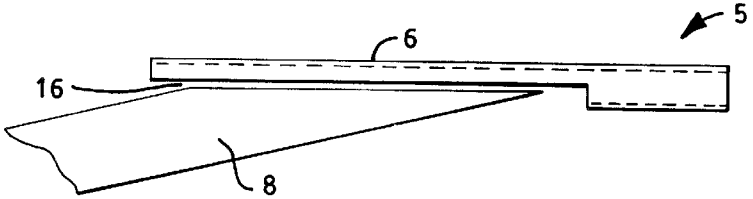
FIGS. 12, 13 and 14 show the orientation of the bottom feed plate to the forming shoe.
Figure 13:
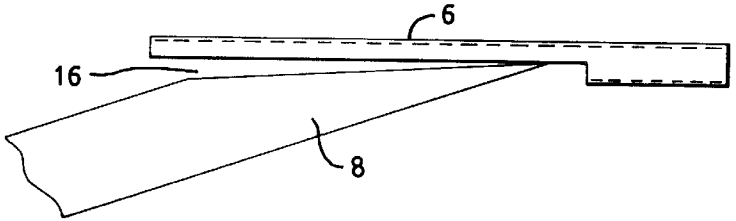
Figure 14:
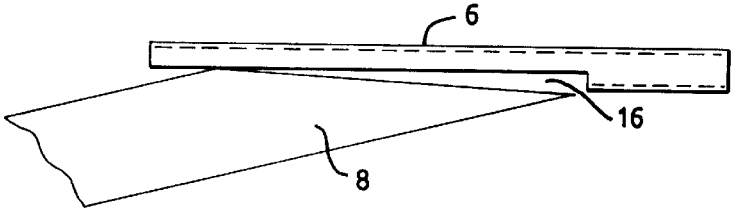

FIGS. 12–14 show a top view of the orientation between the bottom feed plate 8 and the tube former 5. The gap 16 between the bottom feed plate 8 and the forming shoe 6 varies as illustrated when the angle N between the tube longitudinal axis TA and strip longitudinal axis SA is changed. Where the angle N changes significantly, the bottom feed plate 8 may be changed to one with the proper angle. As the angle N changes, the whole feeding means including the top and bottom feed plates 8, 9 and the three drive roller pairs 10 moves with respect to the tube former 5. This is simply accomplished by laterally adjusting the same on the stand 39.

After the tube 1 is substantially formed within the tube former 5 with the leading and trailing edges 3, 4 of the metal strip 2 juxtaposed, pressure is applied on the leading edge 3, leading portion 3*a*, trailing edge 4 and trailing portion 4*a* in the direction of the cylindrical wall 7*w* of the aperture 7*a* such that same substantially conform to the cylindrical wall 7*w*.

Figure 11:
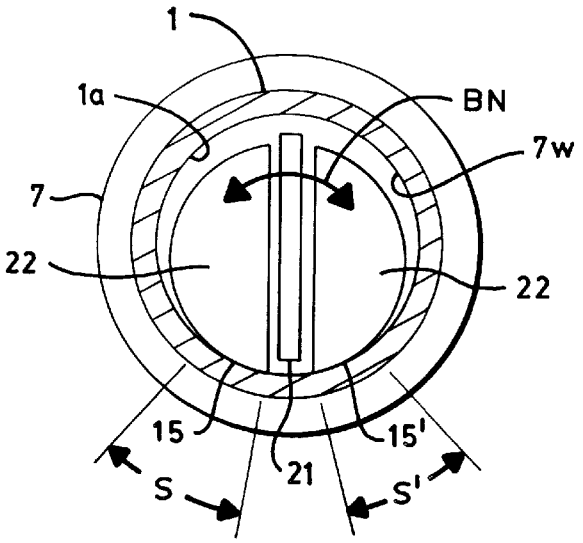
FIG. 11 is schematic partial section view looking into the tube former showing the orientation of the roller set with respect to the tube seam.

In the illustrated embodiment, this pressure is supplied by inner roller sets 20*a*, 20*b* and 20*c* arranged inside the cylindrical aperture 7*a* such that the metal strip 2 passes between the inner roller sets 20*a*, 20*b* and 20*c* and the cylindrical wall 7*w* of the cylindrical aperture 7*a* as illustrated in FIG. 11.

Figure 7:
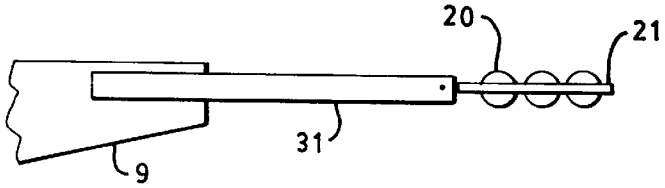
FIG. 7 is a top view of the roller sets and roller bar showing the attachment thereof to the top feed plate via a bracket.
Figure 8:
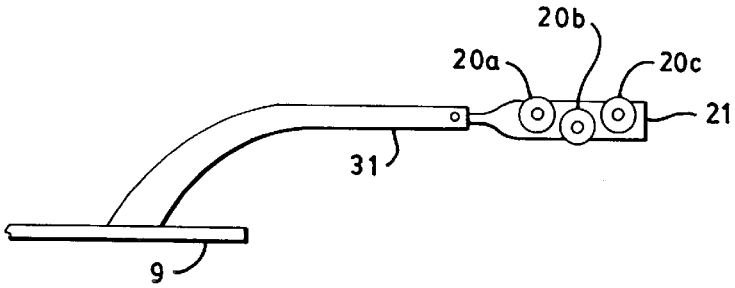
FIG. 8 is a side view of the roller sets and roller bar of FIG. 7.
Figure 9:
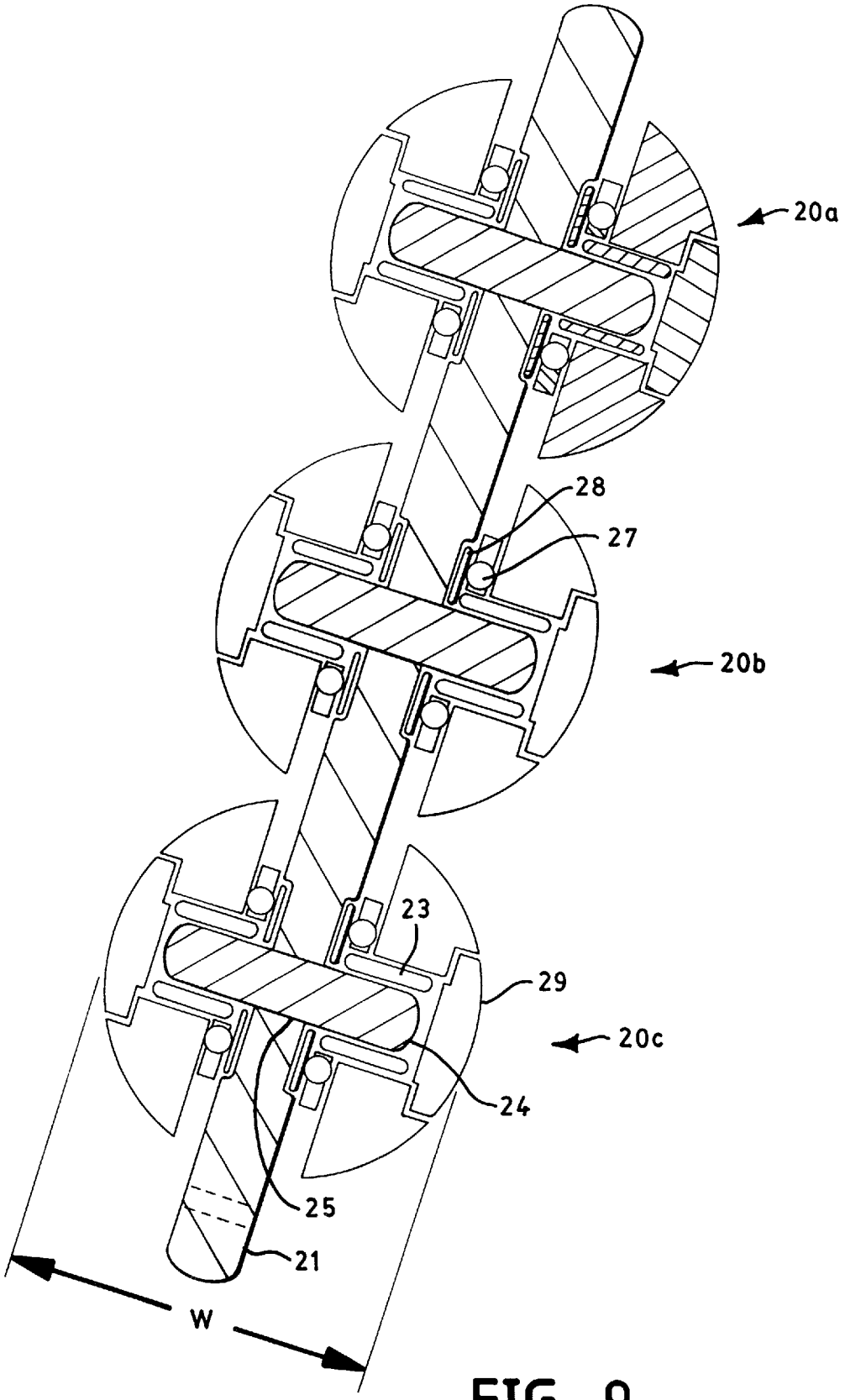
FIG. 9 is sectional view along 9—9 of FIG. 6 showing the details of the roller set construction.
Figure 10:
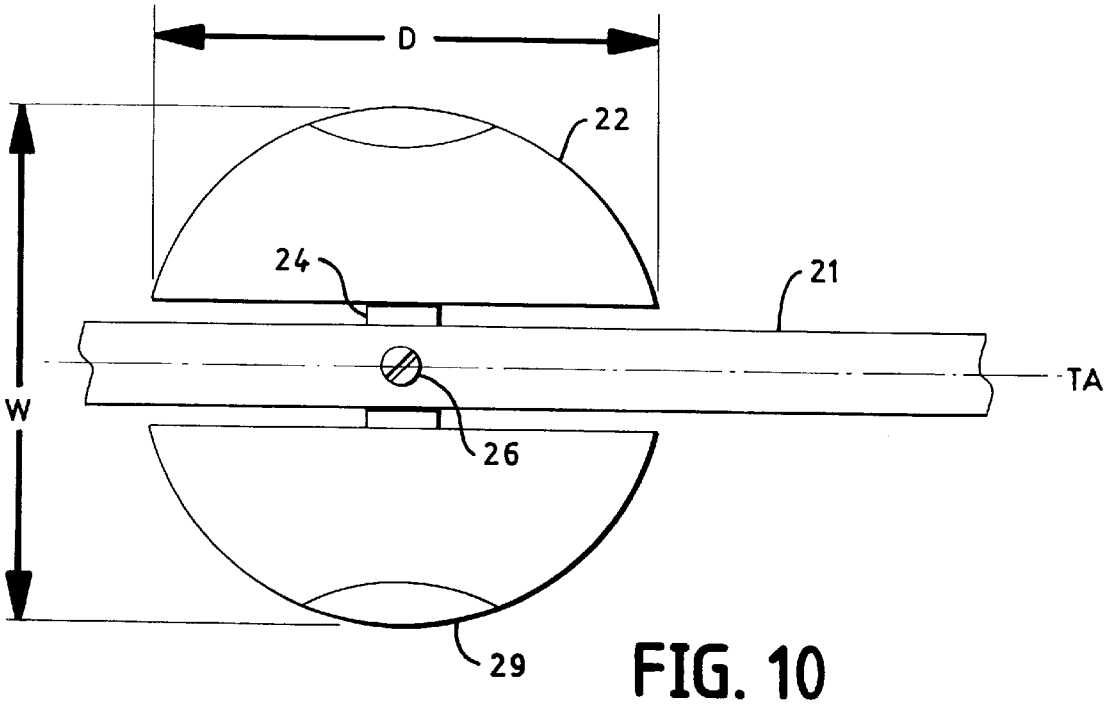
FIG. 10 is a top view of a roller set.

Details of the construction of the roller sets 20 are shown in FIGS. 6–10. As illustrated in FIG. 9, the roller sets 20*a*, 20*b* and 20*c* are rotatably mounted on a roller bar 21. Each roller set 20 is made up of two separate roller sections 22, each mounted on a needle bearing 23 to roller shaft 24. The roller shaft 24 is fixed in a shaft hole 25 in roller bar 21 by a set screw 26. Thrust bearing 27 bears against the roller section on one side and a thrust washer 28 on the other. A button 29 is pressed into the roller section 22 to complete the roller set 20.

Figure 6:
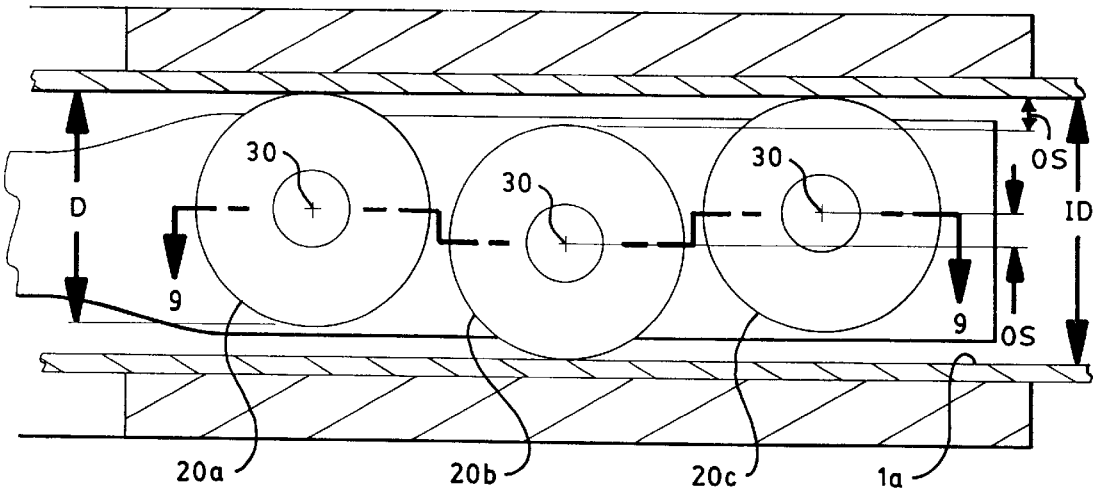
FIG. 6 is a schematic partial section of the sizing shoe showing the orientation of the roller sets and tube.

In FIG. 6 it can be seen that the diameter D of the roller sections 21 is less than the inside diameter ID. The rotational axes 30 of the roller sets 20 are offset as illustrated by a distance OS which corresponds to the difference between the diameter D of the roller sets 20 and the inside diameter ID. The result is that the end roller sets 20*a* and 20*c* bear against the top of the inside wall 1*a* of the tube 1 while the roller set 20*b* bears against the opposite bottom thereof. Pressure is thus exerted on the juxtaposed leading and trailing edges 3, 4 of the metal strip 2 and the adjacent leading and trailing portions 3*a*, 4*a* by one or the other roller sections 22 of roller set 20*b* as shown in FIG. 11. It is these parts of the metal strip 2 which tend to deform during forming, and the roller set 20*b* forces same to conform to the cylindrical wall 7*w*.

The width W of the assembled roller set 20 is slightly less than the inside diameter ID of the tube 1 being formed such that same may pass through the inside of the tube 1. The usual variations in the thickness of the metal strip 2 are considered when determining the width W of the roller sets 20.

As shown in FIGS. 7 and 8, the roller bar 21 is mounted on a bracket 31 which is fixed to the top feed plate 9. The roller bar 21 may be rotated with respect to the bracket 31, as indicated by BN in FIG. 11, so that either area S or S' of the roller set 20*b* may be brought to bear on the seam 15. S and S' indicate those areas where the roller set 20*b* most closely conforms to the cylindrical wall 7*w*.

As illustrated in FIG. 11, roller sets 20*a*, 20*b* and 20*c* exert pressure on a substantial portion of the inner wall 1*a* of the tube 1 in the direction of the cylindrical wall 7*w* such that same substantially conforms thereto.

Figure 16:
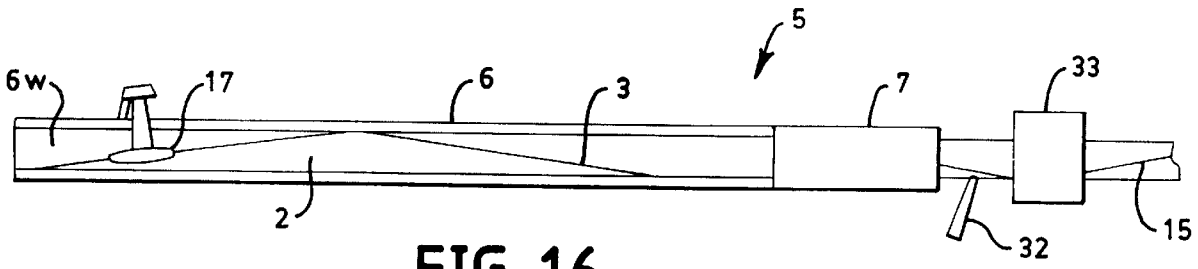
FIG. 16 is a schematic side view of the tube former with a metal strip in place and a finished tube exiting the tube former.
Figure 17:
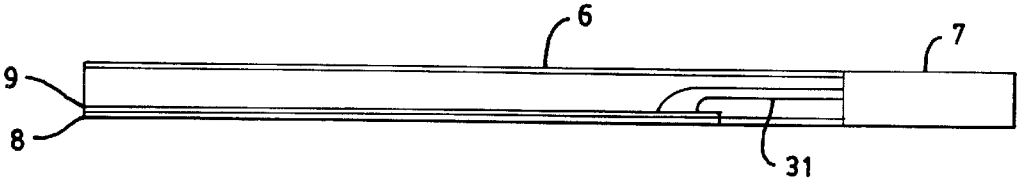
FIG. 17 is a schematic side view of the tube former showing the attachment of the bracket to the top feed plate.

A leading portion roller 17 is arranged such that the leading edge 3 and leading portion 3*a* pass between same and the cylindrical wall 6*w*, as illustrated in FIGS. 3 and 16. The leading portion roller 17 is oriented so as to roll in substantially the direction of the strip longitudinal axis SA, and the outer perimeter of the leading portion roller 17 is shaped to approximately conform to the cylindrical wall 6*w*. The leading edge 3 and leading portion 3*a* are forced thereby into substantial conformity with the cylindrical wall 6*w*.

After the metal strip 2 passes the leading portion roller 17, it is held against the cylindrical wall 6*w* by the edge 9*a* of the top feed plate 9 which is substantially aligned with and in proximity to the cylindrical wall 6*w* as illustrated in FIG. 3. The bottom of edge 9*a* of the top feed plate 9 is beveled to reduce scoring and friction.

The leading portion roller 17 and edge 9*a* of the top feed plate 9 help to form the metal strip 2 into a more uniform cylindrical shape.

A welding head 32 is positioned adjacent to the exit end of the tube former 5 as illustrated in FIG. 16 to fuse the juxtaposed leading and trailing edges 3, 4 together by welding to form a welded seam 15.

Figure 5:
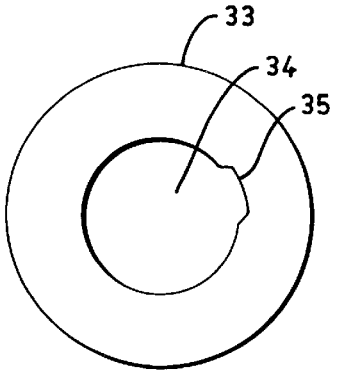
FIG. 5 is an end view of the cooling die.

The leading and trailing edges 3, 4 are maintained in a juxtaposed position until the seam 15 cools sufficiently to maintain the juxtaposed position by passing the tube 1 through a cooling die 33 defining a cooling aperture 34, which has the same diameter as the tube 1. The cooling aperture 34 has a groove 35 along a portion thereof, as illustrated in FIG. 5, so that the welded seam 15 may pass therethrough without being disturbed. By the time the tube 1 exits the cooling die 33, the weld has cooled sufficiently that the seam is maintained. The cooling die 33 may be rotated so that the groove 35 may be aligned with the seam 15 as the pitch P changes due to changes in the width of the metal strip 2.

Figure 4:
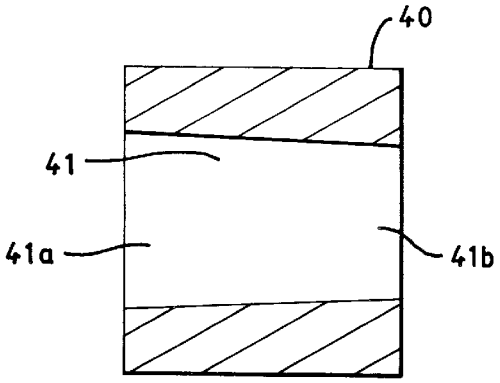
FIG. 4 is a sectional view of the spacer along 4—4 of FIG. 1.

It is preferable to weld material that is beneath the welding head 32. To accomplish this the embodiment of FIG. 1 shows a spacer 40 mounted adjacent to the exit of the tube former 5 and movable along the tube longitudinal axis TA. As illustrated in FIG. 4 the spacer defines a slightly tapered spacer aperture 41. The entrance end 41*a* of the spacer aperture 40 is slightly larger than the tube 1, so as to easily accept same passing into the spacer aperture 41 from the tube former 5. The exit end 41*b* of the spacer aperture 40 is substantially the same size as the tube 1 so the leading and trailing edges 3, 4 are juxtaposed when they exit the spacer aperture 41. The welding head 32 is mounted adjacent to the exit of the spacer aperture 41 and is movable along the tube longitudinal axis TA. With the movable spacer 40 and welding head 32, it is possible to weld the seam 15 always on the top of the tube 1. Since the pitch P changes substantially with small variations in the width of the metal strip 2 it is necessary to move the spacer 40 and welding head 32 when changing strip width if it is desired to weld at the top of the tube 1.

Figure 19:
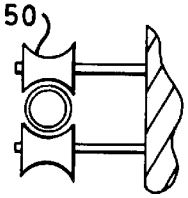
FIGS. 18, 19 and 20 show a roller set for removing irregularities in the cylindrical shape of the tube.
Figure 18:
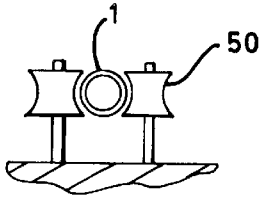
Figure 20:
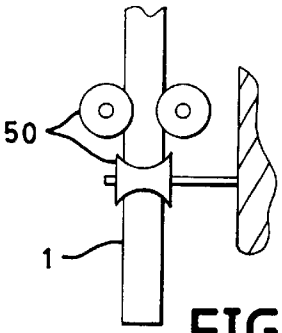

FIGS. 18–20 illustrate a set of forming rollers 50 for removing irregularities in the cylindrical shape of the tube 1. The forming rollers 50 have a perimeter shaped to conform to the desired cylindrical shape of the tube 1 and are arranged in opposed pairs as shown. The finished tube is fed between the forming rollers 50 as shown in FIG. 20.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. An apparatus for making a cylindrical helical seamed tube, having a tube longitudinal axis, from a metal strip having a strip longitudinal axis and parallel longitudinal edges being a leading edge adjacent a leading portion of said metal strip and a trailing edge adjacent a trailing portion of said metal strip, said apparatus comprising:

a tubing former operable to form said metal strip into a helical tube with said leading and trailing edges juxtaposed, said tubing former defining an aperture with a cylindrical wall;

means for continuously feeding said metal strip into said tubing former, said means for continuously feeding operative to maintain said strip longitudinal axis at a substantially constant acute angle with respect to said tube longitudinal axis, said acute angle being between 1 and 25 degrees;

first means to apply pressure, after said tube is substantially formed within said tubing former with said leading and trailing edges juxtaposed, on at least said leading edge, leading portion, trailing edge and trailing portion in the direction of said cylindrical wall such that said leading edge, leading portion, trailing edge and trailing portion substantially conform to said cylindrical wall;

means for fusing said juxtaposed leading and trailing edges together to form a seam; and means for maintaining said leading and trailing edges in a juxtaposed position until said seam cools sufficiently to maintain said juxtaposed position.

2. The invention of claim 1 wherein said substantially constant acute angle between said strip longitudinal axis and said tube longitudinal axis is between 3 and 20 degrees.

3. The invention of claim 1 wherein said substantially constant acute angle between said strip longitudinal axis and said tube longitudinal axis is adjustable.

4. The invention of claim 1 further comprising second means to apply pressure on said leading edge and leading portion of the metal strip in the direction of said cylindrical wall after said leading edge and leading portion enter said tubing former so that said leading edge and leading portion substantially conform with said cylindrical wall of the tubing former.

5. The invention of claim 4 wherein said second means to apply pressure comprises a roller.

6. The invention of claim 1 wherein said means for continuously feeding said metal strip includes means to apply a force on said metal strip in the direction of said strip longitudinal axis and into said tubing former after said leading edge and leading portion have entered said tubing former and been partially formed.

7. The invention of claim 1 wherein said means for continuously feeding said metal strip comprises a pair of upper and lower final drive rollers acting respectively on upper and lower surfaces of said trailing portion of the metal strip.

8. The invention of claim 1 wherein said first means to apply pressure comprises a roller.

9. The invention of claim 8 wherein said first means to apply pressure comprises first, second, and third rollers, said second roller applying a force on said leading edge, leading portion, trailing edge and trailing portion in the direction of said cylindrical wall, and said first and third rollers applying a force on the opposite inside wall of said tube in the direction of said cylindrical wall.

10. The invention of claim 1 wherein said means for maintaining said leading and trailing edges in a juxtaposed position until the weld cools sufficiently to maintain said juxtaposed position comprises a cooling member defining a cooling aperture with a diameter substantially equal to the outside diameter of said tube, said cooling aperture further comprising a groove to accommodate said seam.

11. The invention of claim 1 further comprising a set of forming rollers arranged so that said tube passes therethrough after said seam has cooled in order to remove irregularities in the cylindrical shape of said tube.

* * * * *